US006859186B2

(12) United States Patent
Lizalek et al.

(10) Patent No.: US 6,859,186 B2
(45) Date of Patent: Feb. 22, 2005

(54) FLUSH-MOUNTED ANTENNA AND TRANSMISSION SYSTEM

(75) Inventors: Gary C. Lizalek, Oak Lawn, IL (US); Juan R. Luglio, Wauwatosa, WI (US)

(73) Assignee: Silver Spring Networks, Inc., Butler, WI (US)

( * ) Notice: Subject to any disclaimer, the term of this patent is extended or adjusted under 35 U.S.C. 154(b) by 0 days.

(21) Appl. No.: 10/357,296

(22) Filed: Feb. 3, 2003

(65) Prior Publication Data

US 2004/0150575 A1 Aug. 5, 2004

(51) Int. Cl.[7] ..... H01Q 13/10
(52) U.S. Cl. ..... 343/767; 343/789; 343/769
(58) Field of Search ..... 343/769, 789, 343/767, 771, 700 MS

(56) References Cited

U.S. PATENT DOCUMENTS 3,568,206 A * 3/1971 Sisson et al. ..... 343/769
4,229,744 A 10/1980 Luedtke et al. ..... 343/769
4,675,685 A * 6/1987 Finken ..... 343/789
4,682,180 A 7/1987 Gans ..... 343/769
4,994,817 A * 2/1991 Munson et al. ..... 343/769
5,132,698 A 7/1992 Swineford ..... 343/846
6,121,936 A 9/2000 Hemming et al. ..... 343/769
6,225,959 B1 * 5/2001 Gordon ..... 343/769
6,369,769 B1 4/2002 Nap et al. ..... 343/719

* cited by examiner

*Primary Examiner*—Don Wong
*Assistant Examiner*—Ephrem Alemu
(74) *Attorney, Agent, or Firm*—Michael Best & Friedrich LLP

(57) ABSTRACT

An apparatus mounted beneath or behind a surface and being operable to transmit or receive wireless communication signals for transmitting information from one location to a remote location. The apparatus includes an antenna mounted substantially flush with a surface. The apparatus also includes a communication device and a matching network having a radial transmission line. The communication device is connected to the antenna via the matching network and includes either a transmitter, a receiver or a transceiver.

32 Claims, 5 Drawing Sheets

FLUSH-MOUNTED ANTENNA AND TRANSMISSION SYSTEM

BACKGROUND OF THE INVENTION

The present invention relates generally to antennas for effecting wireless communication from an electronic device, and particularly, to a flush-mounted antenna for the device.

There are many applications in which it is desired to obtain information from a electronic device via wireless communication. Often, the device is located beneath a surface of a supporting structure, integrated into a surface of a supporting structure and/or positioned within a housing or enclosure having an outer surface. In order to effect wireless communication, the communication signal much somehow be transmitted through the surface. In the usual case, this is done by inserting an antenna through a hole in the surface.

SUMMARY OF THE INVENTION

In some applications, however, it is desirable that the antenna not extend outward from the surface, but rather be mounted flush with the surface. Often, mounting the antenna flush with the surface limits the area the antenna can occupy. Furthermore, mounting the antenna flush with the surface may limit the ability of the device to transmit and/or receive signals through the antenna. It therefore becomes desirable, in these applications, to provide a matching network for the device that will not significantly reduce the total efficiency of the device during transmission and/or reception and that can be configured in a small, compact construction.

Accordingly, the invention provides an apparatus mounted beneath or behind a surface and being operable to transmit or receive wireless communication signals for transmitting information from one location to a remote location. The apparatus includes an antenna mounted substantially flush with a surface. In one embodiment, the antenna is an annular slot antenna.

In another embodiment, the invention provides an apparatus for transmitting and/or receiving wireless communication signals. The apparatus is positioned beneath a surface and includes an antenna positioned substantially flush with the surface. The apparatus also includes a communication device and a matching network having a radial transmission line. The communication device is connected to the antenna via the matching network and includes either a transmitter, a receiver or a transceiver.

In still another embodiment, the invention provides an apparatus for transmitting and/or receiving wireless communication signals. The apparatus is positioned beneath a surface and includes an annular slot antenna positioned substantially flush with the surface. The apparatus also includes a transmitter coupled to the antenna via a radial transmission line.

Figure 1:
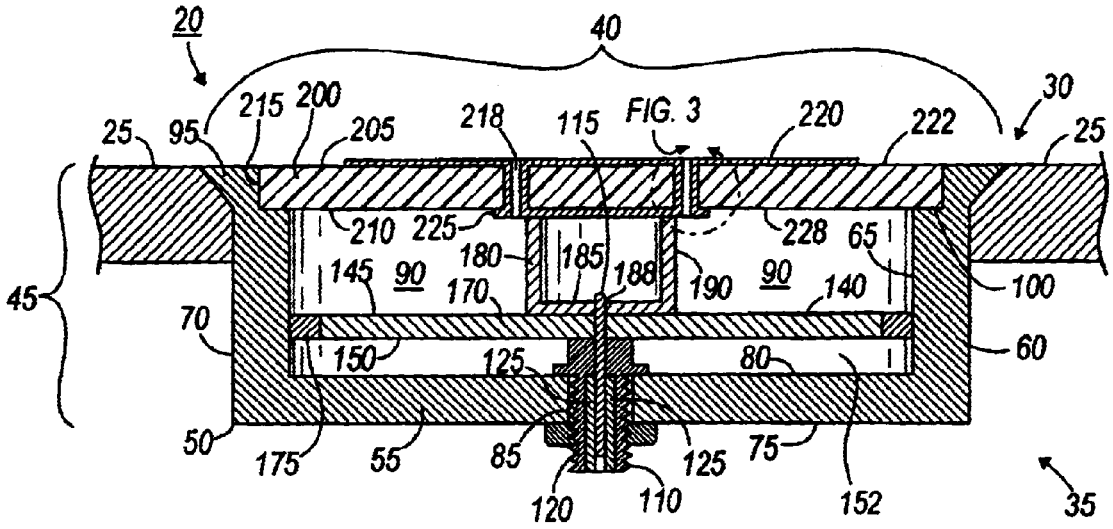
FIG. 1 is a section view of an apparatus embodying the invention.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting, and coupling. Further, "connected" and "coupled" are not restricted to physical or mechanical connections or couplings.

DETAILED DESCRIPTION

Figure 3:
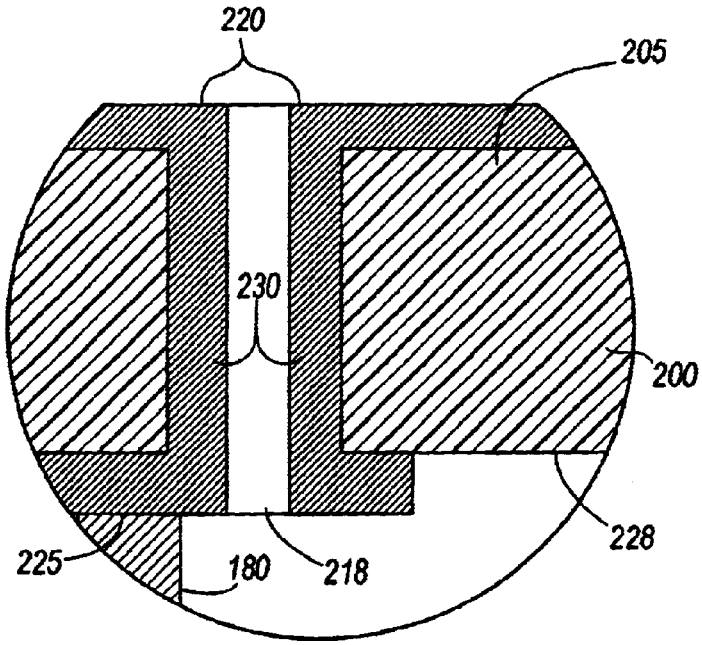
FIG. 3 is a detailed view of the encircled portion of the apparatus as shown in FIG. 1.
Figure 2:
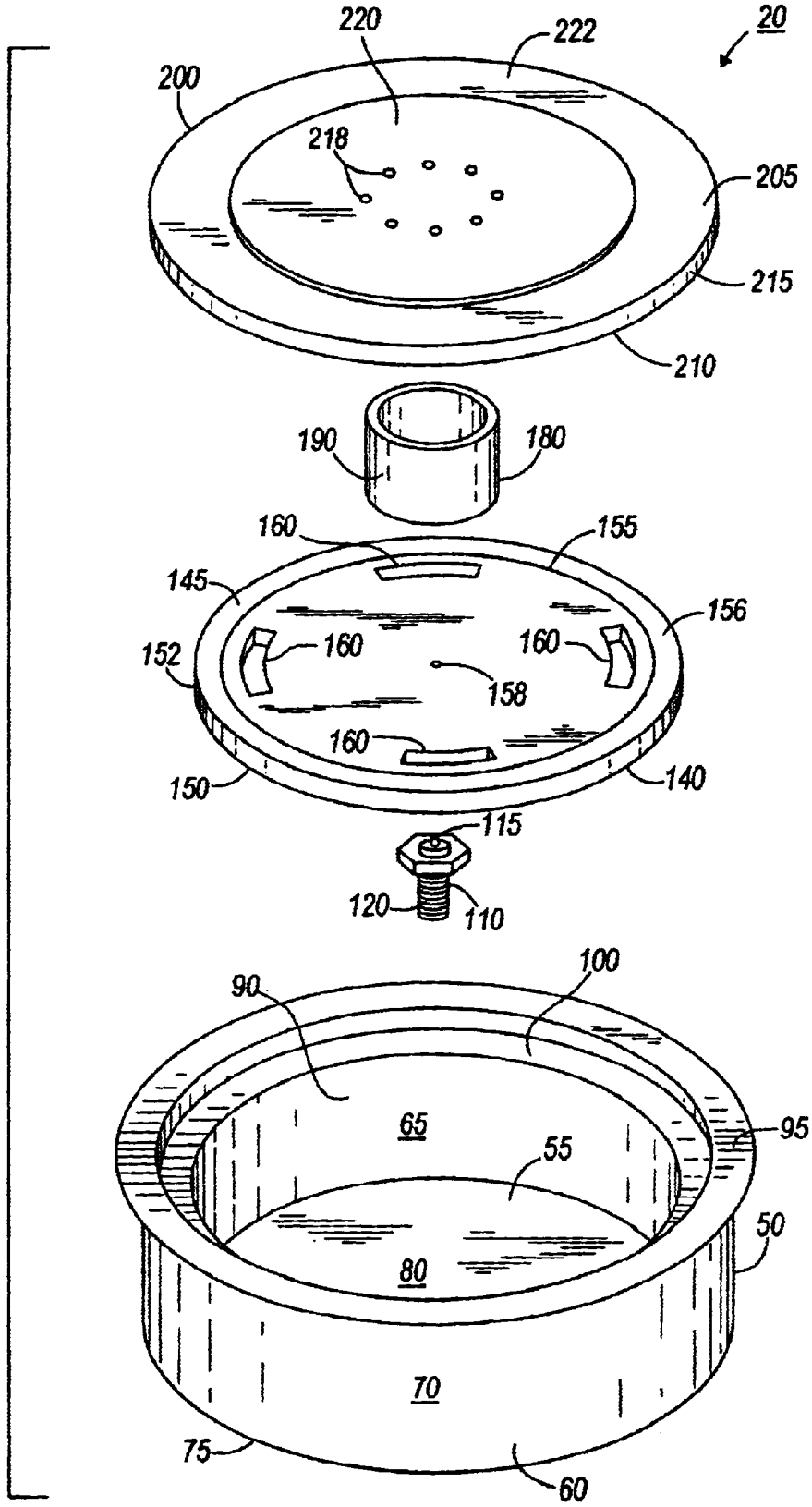
FIG. 2 is an exploded view of the apparatus shown in FIG. 1.
Figure 6:
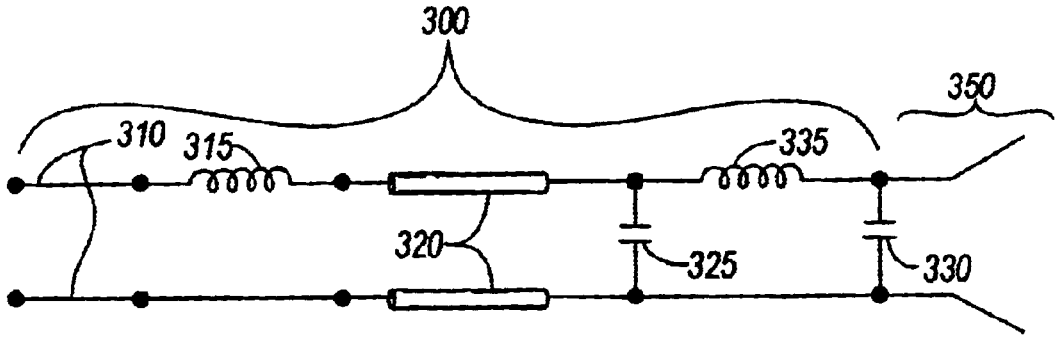
FIG. 6 is a schematic diagram illustrating a first electrical circuit equivalent of the apparatus shown in FIG. 1.
Figure 7:
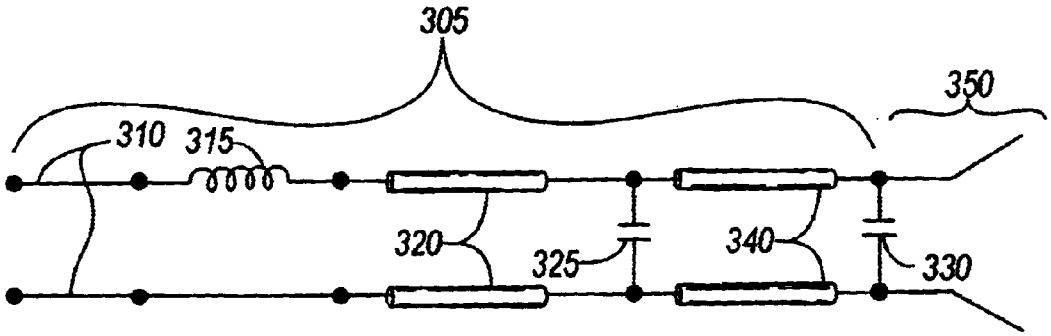
FIG. 7 is a schematic diagram illustrating a second electrical circuit equivalent of the apparatus shown in FIG. 1.

A first embodiment of an apparatus 20 in accordance with the present invention is shown in FIGS. 1–3 and illustrated schematically in FIGS. 6 and 7. The apparatus 20 is configured to be positioned substantially beneath a surface 25 as shown in FIG. 1. In some constructions, the surface 25 is an outer surface of a housing or enclosure that defines a cavity into which a communication device, such as, for example, a transmitter, a receiver and/or a transceiver (all not shown), is positioned. In some constructions, the surface 25 is included in a support structure or is a portion of a street, sidewalk or ground.

The apparatus 20 includes a top portion 30 which is positioned substantially flush with the surface 25 and a bottom portion 35 which is positioned substantially beneath the surface 25. The top portion 30 includes an antenna 40, which will be discussed below. The bottom portion 35 includes a matching network 45 to couple the antenna 40 to the communication device. In some constructions, the matching network 45 couples the antenna 40 to a transmission line (not shown), such as coaxial cable, which in turn couples to the communication device.

Still referring to FIGS. 1–3, the apparatus 20 includes a can 50. In the illustrated embodiment, the can 50 is substantially cylindrical and includes a base 55 and a sidewall 60. As shown in FIGS. 1 and 2, the diameter of the base 55 is substantially greater than the height of the sidewall 60. In other constructions and in other embodiments, the can 50 may have a different shape and/or size than the can 50 illustrated in FIGS. 1–3. In some constructions, the can 50 is formed from a conductive material or metal. In other constructions, the can 50 is a plastic mold which is plated with a conductive material or metal.

The sidewall 60 of the can 50 includes an inner surface 65 and an outer surface 70. The base 55 of the can 50 includes a bottom surface 75 and a top surface 80. The base 55 also defines an aperture 85. The top surface 80 of the base 55 and the inner surface 65 of the sidewall 60 partially define a cavity 90, i.e., the interior portion of the can 50.

The can 50 also includes an enlarged lip 95 extending from the top of the sidewall 60. The lip 95 extends around the entire length of the sidewall 60. A portion of the lip 95 is cut away forming an annular shelf 100.

The apparatus 20 also includes a connecting element 110 which extends through the aperture 85 in the base 55 of the can 50. Transmission line, such as coaxial cable (not shown), connects to the connecting element 110, as will be discussed below. The connecting element 110 is a standard RF connector, such as a threaded coaxial connector. In the illustrated embodiment, the connecting element 110 is an SMA connector configured to receive the coaxial cable transmission line. As illustrated in FIGS. 1 and 2, the connecting element 110 includes an inner conductor feed 115 positioned near the top of the connecting element 110 and extending through the middle of the connecting element 110. In this embodiment, the inner conductor feed 115 couples to the center conductor of the coaxial cable when a connection between the cable and the connecting element 110 is made.

The connecting element 110 also includes an outer conductor feed 120 substantially surrounding the inner conductor feed 115. The outer conductor feed 120 couples to the outer conductor or shield of the coaxial cable when a connection between the cable and the connecting element 110 is made. The outer conductor feed 120 also electrically couples to the base 55 of the can 50. The inner conductor feed 115 is electrically isolated by the outer conductor feed 120 by an insulator 125 formed from an insulating material, such as, for example, plastic.

The apparatus 20 also includes a tuner element 140 positioned within the cavity 90 of the can 50. In the illustrated embodiment, the tuner element 140 is a round plate having a top side 145, a bottom side 150, a sidewall 152 and an aperture 158. In other constructions and in other embodiments, the tuner element 140 can vary in shape and/or size without deviating from the spirit of the invention. The tuner element 140 is positioned above the top surface 80 of the base 55 of the can 50 by the connecting element 110 and forms a space 152 between the top surface 80 of the base 55 and the bottom side 150 of the tuner element 140. The inner conductor feed 115 of the connecting element 110 extends through the aperture 158 of the tuner element 140 and electrically couples to the tuner element 140. During operation, the base 55 of the can 50 and the tuner element 140 form a radial transmission line 320 (shown schematically in FIGS. 6 and 7).

In some constructions, the tuner element 140 is a non-conductive disc, such as a plastic disc, plated with a conductive material. As illustrated in FIG. 2, the tuner element 140 is plated such that a portion 155 of the top side 145 is plated with the conductive material and a portion (not shown) of the bottom side 150 is plated with the conductive material. In this construction, the tuner element 140 also includes apertures 160. The sidewalls defining the apertures 160 are also plated such that the plated portion 155 of the top side 145 is electrically coupled to the plated portion of the bottom side 150. As shown in FIG. 2, the plated portion 155 of the top side 145 and the plated portion of the bottom side 150 do not extend across the entire diameter of the tuner element 140. Stated differently, there is a non-conductive annular region 156 between the tuner element 140 and the can 50 along the entire periphery of the tuner element 140, and on both the top side 145 and the bottom side 150.

In other constructions, the tuner element 140 is a conductive disc. As shown in FIG. 1, the tuner element 140 includes a conductive disc 170 surrounded by a non-conductive ring or gap 175. In this construction, the top side 145 and the bottom side 150 are electrically coupled by the conductive disc 170.

The apparatus 20 also includes a conductive post 180 positioned on top of the tuner element 140. The conductive post 180 is electrically coupled to the inner conductor feed 115 of connecting element 110 either directly or via the tuner element 140. In some constructions, the conductive post 180 is a solid cylinder of conductive material or metal. In other constructions, the conductive post 180 is a hollow cylinder of conductive material. In the embodiment illustrated in FIGS. 1 and 2, the conductive post 180 includes a conductive base 185 defining an aperture 188 and coupling to a conductive sidewall 190. As shown in FIGS. 1 and 2, the inner conductor feed 115 extends through the aperture 188 and electrically couples to the conductive post 180. In other constructions, the conductive post 180 is a plastic cylinder plated with a conductive material.

The apparatus 20 also includes a top plate 200 positioned on top of the post 180. As shown in FIG. 1, the top plate 200 is configured to be positioned on the annular shelf 100 of the can 50. In some constructions, the top plate 200 is mounted to the post 180. In other constructions, the top plate 200 is mounted to the annular shelf 100, and in further constructions, the top plate 200 is mounted to both the annular shelf 100 and the post 180.

The top plate 200 includes a top side 205, a bottom side 210, a sidewall 215 and apertures 218. As shown in FIGS. 1–3, the top plate 200 is plated such that the top side 205 includes a first conductive portion 220 and a first non-conductive portion 222, and the bottom side 210 includes a second conductive portion 225 and a second non-conductive portion 228. As shown in FIGS. 1 and 2, the first conductive portion 220 is substantially circular. As shown in FIG. 3, the first conductive portion 220 is electrically coupled to the second conductive portion 225 by the conductive sidewalls 230 defining the apertures 218.

Referring to FIG. 1, the first conductive portion 220 and the first non-conductive portion 222 of the top plate 200 and the lip 95 of the can 50 form an annular slot antenna 40. In some constructions, the annular slot antenna 40 radiates and/or receives signals at a center frequency of approximately 900 MHz and is an omni-directional antenna. The annular slot antenna 40 is positioned substantially flush with the surface 25. The remainder of the can 50, the connecting element 110, the tuner element 140, the post 180 and the second conductive portion 225 of the top plate 200 form the matching network 45. Furthermore, when the antenna 40 is radiating, the can 50 serves as a reflector. During operation, a portion of the radiation transmitted by the antenna 40 that is directed at the can 50 is reflected by the conductive base 55 and conductive sidewall 60 of the can 50.

FIG. 6 is a schematic diagram illustrating a first electrical circuit equivalent for the matching network 45 and the antenna 40 included in the apparatus 20 illustrated in FIGS. 1–3. FIG. 7 is a schematic diagram illustrating a second electrical circuit equivalent for the matching network 45 and the antenna 40 included in the apparatus 20 illustrated in FIGS. 1–3.

Referring to FIGS. 6 and 7, the matching network 45 can be equivalent to both the first electrical circuit matching network 300 and the second electrical circuit matching network 305. Both matching networks 300 and 305 include a conductor 310, whose structural equivalent is the connecting element 110, and an inductor 315, which represents the inductance of the inner conductor feed 115.

The matching networks 300 and 305 also include a radial transmission line 320, a first capacitor 325 and a second capacitor 330. The radial transmission line 320 is the electrical circuit equivalent for the base 55 of the can 50 and the tuning element 140. The first capacitor 325 is the electrical circuit equivalent for the capacitance produced between the tuning element 140 and the sidewall 60 of the can 50. The second capacitor 330 is the electrical circuit equivalent for the capacitance produced between the second conductive portion 225 of the top plate 200 and the sidewall 60 of the can 50.

The difference between the first matching network 300 and the second matching network 305 is the electrical circuit equivalent for the post 180. For the first matching network 300, the electrical circuit equivalent for the post 180 is a second inductor 335 representing the inductance of the post 180. However, the post 180 may also be represented electrically by a low impedance transmission line, such as the transmission line 340 included in the second matching network 305.

The electrical circuit matching networks 300 and 305 and the structural equivalent, matching network 45, are used to efficiently match the impedance of the antenna 40 (shown schematically as antenna 350) to the impedance of the coaxial cable transmission line (not shown) coupling the apparatus 20 to the communication device (not shown). Typically, coaxial cable has an impedance of approximately 50 ohms. In most constructions, the annular slot antenna 40 has a high and/or complex impedance, such as, for example, an impedance greater than approximately 100 ohms and/or an impedance having a large capacitive reactance. In the illustrated embodiment, the annular slot antenna 40 has an impedance of approximately 200 ohms to approximately 300 ohms and has a highly capacitive reactance.

In the illustrated embodiment, the dimensions of the components included in the matching network 45 are configured to efficiently match the impedance of the antenna 40 to the impedance of the coaxial cable transmission line (not shown). In the illustrated embodiment, the cavity 90 defined by the can 50 has a height of approximately 1-inch ("in") and a diameter of approximately 3.25-in. The sidewall 60 has a thickness of approximately 0.2-in. The tuner element 140 has a diameter of approximately 3.25-in and a thickness of approximately 0.2-in. The conductive portion 155 of the tuner element 140 has a diameter of approximately 3.0-in. The post 180 has a diameter of approximately 0.9-in and a height of approximately 0.6-in. The top plate 200 has a diameter of approximately 3.7-in. The sidewall 215 of the top plate 200 has a height of approximately 0.2-in, and the first conductive portion 220 of the top plate 200 has a diameter of approximately 2.7-in.

Figure 4:
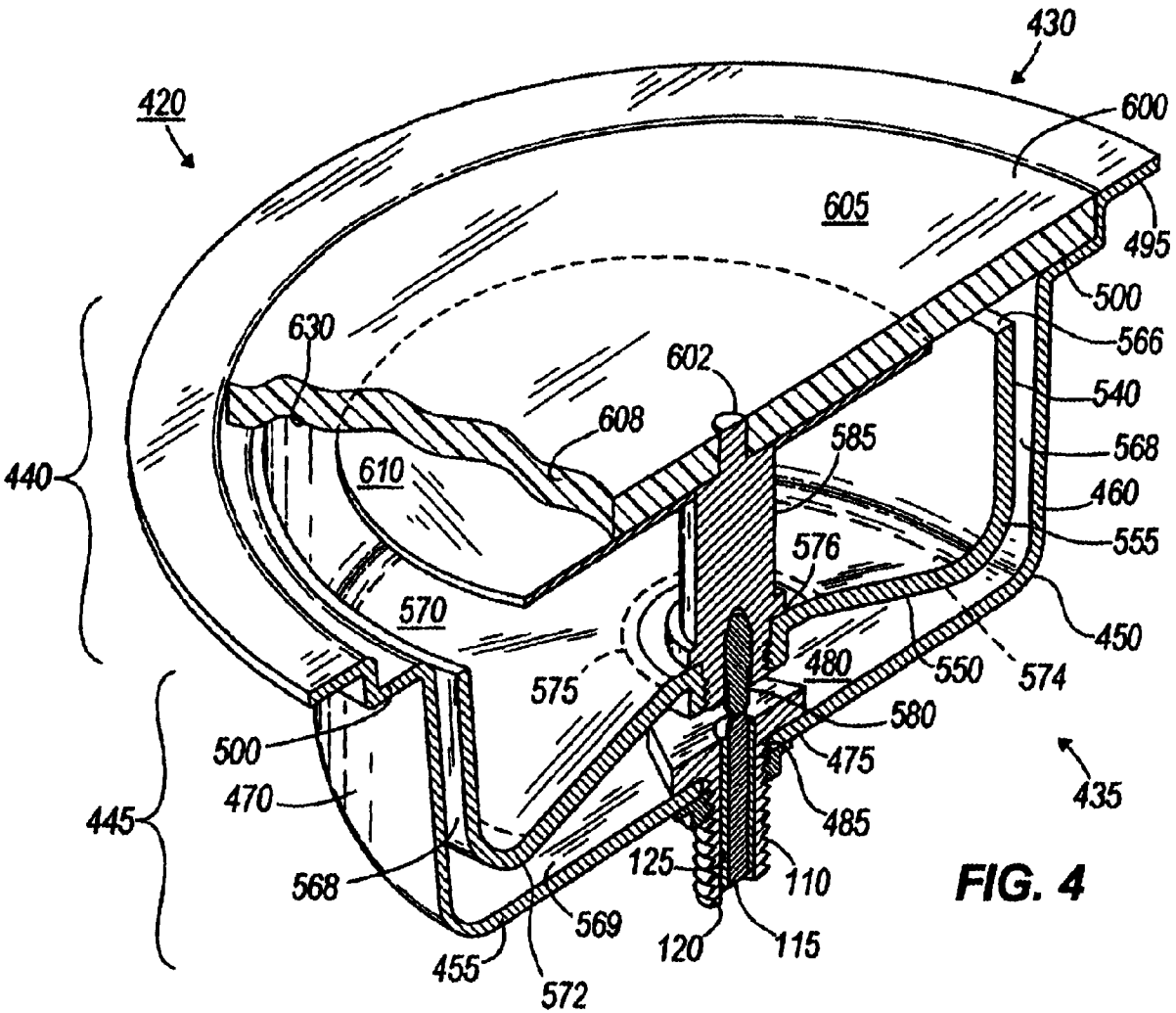
FIG. 4 is a perspective sectional view of another apparatus embodying the invention with a portion of the apparatus broken away.
Figure 5:
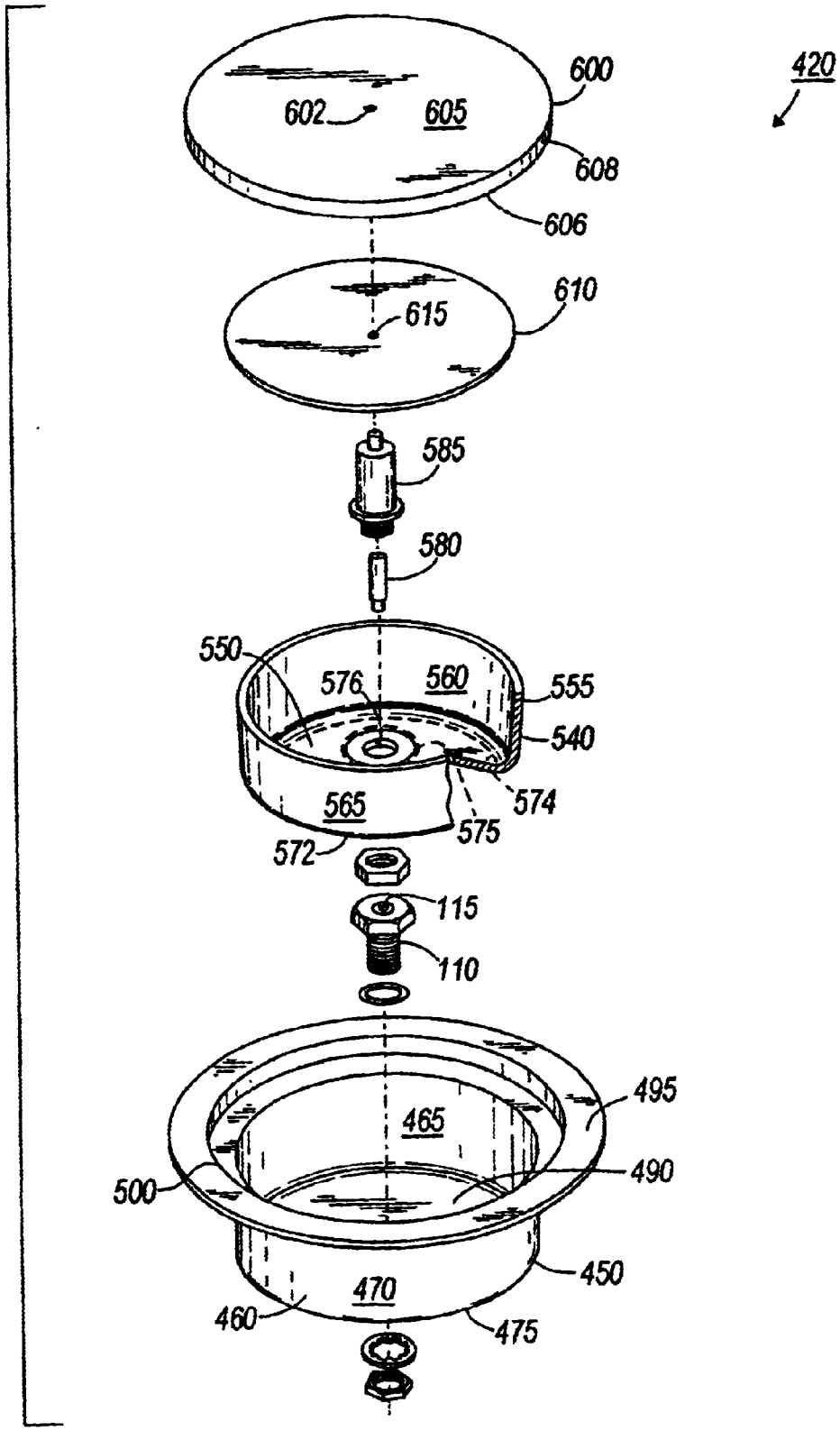
FIG. 5 is an exploded view of the apparatus shown in FIG. 4 with another portion of the apparatus broken away.
Figure 8:
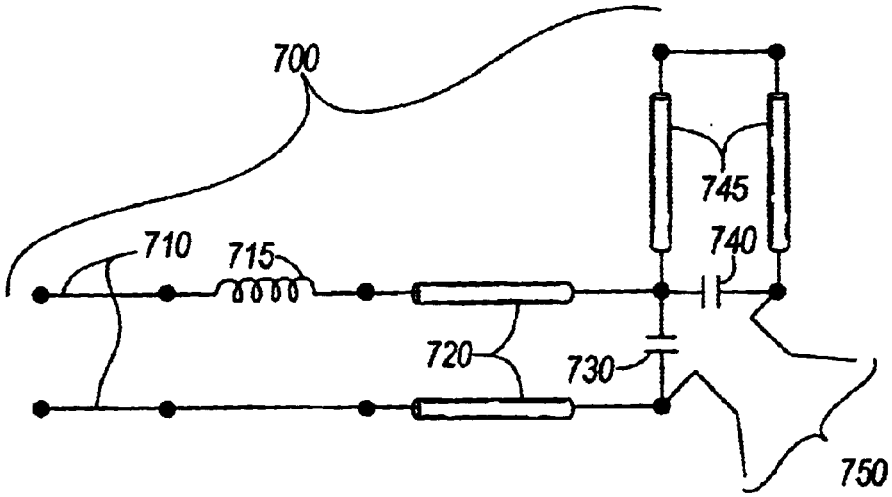
FIG. 8 is a schematic diagram illustrating an electrical circuit equivalent of the apparatus shown in FIG. 4.

Another embodiment of an apparatus 420 in accordance with the present invention is shown in FIGS. 4 and 5 and illustrated schematically in FIG. 8. Common elements have the same reference number as shown in the drawings relating to the apparatus 20.

Similar to the apparatus 20 shown in FIGS. 1–3, the apparatus 420 includes a top portion 430 which is positioned substantially flush with the surface 25 (shown in FIG. 1) and a bottom portion 435 which is positioned substantially beneath the surface 25. The top portion 430 includes an antenna 440, and the bottom portion 435 includes a matching network 445 to couple the antenna 430 to the communication device. In some constructions, the matching network 445 couples the antenna 440 to a transmission line (not shown), such as coaxial cable, which in turn couples to the communication device.

Referring to FIGS. 4 and 5, the apparatus 420 includes a can 450 similar to the can 50 shown in the first embodiment. As shown in FIGS. 4 and 5, the can 450 is substantially cylindrical and is formed from a conductive material, such as metal.

Similar to the can 50 shown in FIGS. 1 and 2, the can 450 includes a base 455 and a sidewall 460. The sidewall 460 of the can 450 includes an inner surface 465 and an outer surface 470, and the base 455 of the can 450 includes a bottom side or surface 475 and a top side or surface 480. The base also defines an aperture 485. The top surface 480 of the base 455 and the inner surface 465 of the sidewall 460 partially define a cavity 490, i.e., the interior portion of the can 450. The can 450 also includes an enlarged lip 495 extending from the top of the sidewall 460. The lip 495 extends around the entire length of the sidewall 460. As shown in FIGS. 4 and 5, a portion of the lip 495 is cut away forming an annular shelf 500.

In the illustrated embodiment, the connecting element 110 extends through the aperture 485 of the can 450. Similar to the apparatus 20 in the first embodiment, the outer conductor feed 120 of the connecting element 110 electrically couples to the can 450.

As illustrated in FIGS. 4 and 5, the apparatus 420 also includes a tuning cup 540 as the tuner element. The tuning cup or tuner element 540 includes an indented base 550 and a sidewall 555. The sidewall 555 includes an inner surface 560, an outer surface 565 and a top surface 566. As shown in FIG. 4, the apparatus 420 includes a space 568 between the inner surface 465 of the sidewall 460 of the can 450 and the outer surface 565 of the sidewall 555 of the tuner element 540. Also shown in FIG. 4, the apparatus 420 includes another space 569 between the base 550 of the tuner element 540 and the top surface 480 of the can 450. During operation, the base 455 of the can 450 and the tuner element 540 form a radial transmission line 720 (shown schematically in FIG. 8).

In the illustrated embodiment, the base 550 of the tuner element 540 includes a top surface 570, a bottom surface 572, a distal perimeter 574, a proximal perimeter 575 and an aperture 576. As shown in FIGS. 4 and 5, proximal perimeter 575 of the base 550 is raised compared to the distal perimeter 574 of the base 550. The result is that the height of the space 569 between the bottom surface 572 of the tuner element 540 and the top surface 480 of the can 450 is larger near the proximal perimeter 575 than near the distal perimeter 574.

The apparatus 420 also includes a pogo pin 580 coupling a post 585 to the inner conductor feed 115 of the connecting element 110. As shown in FIG. 4, the post 585 and the pogo pin 580 extend through the aperture 576 of the tuner element 540 to electrically couple to the inner conductor feed 115. Thus, the tuner element 540 electrically couples to the inner conductor feed 115 of the connecting element 110 via the post 585 and the pogo pin 580.

Similar to the apparatus 20 in the first embodiment, the apparatus 420 includes a top plate 600 positioned on top of the post 585. As shown in FIG. 4, the top plate 600 is configured to be positioned on top of the post 585 and on top of the annular shelf 500 of the can 450. In the illustrated embodiment, the top plate 600 defines an aperture 602 to receive the post 585.

As shown in FIGS. 4 and 5, the top plate 600 includes a top side 605, a bottom side 606 and a sidewall 608. In the illustrated embodiment, the top plate 600 is a non-conductive plate, such as a plastic plate, and does not include a conductive portion positioned on the top side 605 of the plate 600 (such as the first conductive portion 220 as shown in FIGS. 1–3). Rather, the apparatus 420 includes a circular conductive plate 610 positioned on the bottom side 606 of the top plate 600. In some constructions, the conductive plate 610 is adhered to the bottom side 606 of the top plate 600 with a conductive or non-conductive adhesive. In other constructions, the conductive plate 610 defines an aperture 615 to receive the post 585 and is positioned and held near the bottom side 606 by the post 585. In further constructions, the conductive plate 610 is plated onto the bottom side 606 of the top plate 600. When the conductive plate 610 is positioned on the bottom side 606 of the top plate 600 and the apparatus 420 is assembled, the conductive plate 610 defines a non-conductive portion 630 of the top plate 600 which extends between the lip 495 of the can 450 and the conductive plate 610.

Referring to FIG. 4, the conductive plate 610 and the non-conductive portion 630 of the top plate 600 and the lip 495 of the can 450 form an annular slot antenna 440. Similar to the annular slot antenna 40 illustrated in FIGS. 1–3, the annular slot antenna 440 is also an omni-directional antenna and radiates and/or receives signals at a center frequency of approximately 900 MHz. Also similar to the first embodiment illustrated in FIGS. 1–3, the remainder of the can 450, the connecting element 110, the tuner element 540, the post 585 and the pogo pin 580 form the matching network 445. Furthermore, similar to the can 50 of the first embodiment, the can 450 of the second embodiment serves as a reflector when the antenna 440 is radiating. During operation, a portion of the radiation transmitted by the antenna 440 that is directed at the can 450 is reflected by the conductive base 455 and conductive sidewall 460 of the can 450.

Referring to FIG. 8, the matching network 445 is equivalent to the electrical circuit matching network 700. The matching network 700 includes a conductor 710, whose structural equivalent is the connecting element 110, an inductor 715, which represents the inductance of the inner conductor feed 115 and the pogo pin 585, and a radial transmission line 720. The radial transmission line 720 is the electrical circuit equivalent for the base 455 of the can 450 and the base 550 of the tuning element 540.

The matching network 700 also includes a first capacitor 730, a second capacitor 740 and a series shorted stub tuner 745. The first capacitor 730 is the electrical circuit equivalent for the capacitance produced across the space 568. The second capacitor 740 is the electrical circuit equivalent for the capacitance produced between the top surface 566 of the sidewall 555 of the tuner element 540 and the conductive plate 610. The shorted stub tuner 745 is the electrical circuit equivalent of the coaxial transmission line formed by the sidewall 555 of the tuner element 540 and the post 585.

Similar to the matching networks 300 and 305, the electrical circuit matching network 700 and the structural equivalent, matching network 445, is used to efficiently match the impedance of the antenna 440 (shown schematically as antenna 750) to the impedance of the coaxial cable transmission line (not shown) coupling the apparatus 420 to the communication device (not shown). As stated previously, coaxial cable typically has an impedance of approximately 50 ohms. In most constructions, the annular slot antennas 440 has a high and/or complex impedance, such as, for example, an impedance greater than approximately 100 ohms and/or an impedance having a large capacitive reactance. In both the first embodiment and the second embodiment, the antennas 40 and 440 each have an impedance of approximately 200 ohms to approximately 300 ohms and has a highly capacitive reactance.

As stated previously, the dimensions of the components included in both matching networks 45 and 445 are configured to efficiently match the impedance of the antennas 40 and 440 to the impedance of the coaxial cable transmission lines (not shown). In the embodiment shown in FIGS. 4 and 5, the cavity 490 defined by the can 450 has a height of approximately 0.9-in and a diameter of approximately 2.3-in. The tuner element 540 has a diameter of approximately 2.1-in, and the sidewall 555 of the tuner element 540 has a height of approximately 0.7-in. The post 585 has a diameter of approximately 0.3-in and a height of approximately 0.55-in. The top plate 600 has a diameter of approximately 2.75-in. The sidewall 608 of the top plate 600 has a height of approximately 0.125-in, and the conductive plate 610 has a diameter of approximately 1.85-in. In other constructions and in other embodiments, the dimensions of the components included in the matching networks 45 and 445 are greater than or less than the dimensions listed of the components shown in FIGS. 1–5.

Thus, the invention provides, among other things, an apparatus for transmitting and/or receiving wireless communication signals. Various features of the invention are set forth in the following claims.

What is claimed is:

1. An apparatus positioned beneath a surface, the apparatus comprising:

an antenna positioned substantially flush with the surface, the antenna capable of either receiving radiation or transmitting radiation when excited;

a communication device coupled to the antenna; and a matching network coupled to the antenna and to the communication device, the matching network including a radial transmission line, the matching network including a can having a base and a sidewall, the base of the can and the sidewall of the can defining a cavity, the matching network further including a tuner element positioned within the cavity of the can.

2. The apparatus as set forth in claim 1, wherein the antenna is an annular slot antenna.

3. The apparatus as set forth in claim 1, wherein the matching network further includes a connecting element coupling the matching network to the communication device.

4. The apparatus as set forth in claim 1, wherein the matching network further includes a post coupling the antenna to the tuner element.

5. The apparatus as set forth in claim 4, wherein the radial transmission line includes the tuner element and the base of the can.

6. The apparatus as set forth in claim 4, wherein the can further includes a diameter measured across the base and a height measured along the sidewall, the diameter of the can being greater than the height of the can.

7. The apparatus as set forth in claim 1, wherein the communication device includes a transmission line and wherein the matching network couples the antenna to the transmission line of the communication device.

8. The apparatus as set forth in claim 1, wherein the matching network has an equivalent electrical circuit including a radial transmission line, a first capacitor, a second capacitor, and an inductor.

9. The apparatus as set forth in claim 8, wherein the equivalent electric circuit of the matching network further includes a series shorted stub tuner.

10. The apparatus as set forth in claim 1, further comprising:

the can further includes a lip extending from the sidewall, the lip of the can being included in the antenna; and a top plate having a conducting portion and a non-conducting portion, the conducting portion and the non-conducting portion being included in the antenna.

11. The apparatus as set forth in claim 10, wherein the lip of the can defines an annular shelf, and wherein a portion of the top plate is positioned on the annular shelf.

12. The apparatus as set forth in claim 10, wherein the matching network includes:

a post coupling the top plate to the tuner element.

13. The apparatus as set forth in claim 12, further comprising a connecting element having a first conductor feed and a second conductor feed, the first conductor feed electrically couples to the tuner element, the post and the top plate, the second conductor feed electrically couples to the can.

14. The apparatus as set forth in claim 13, wherein a transmission line having a first conductor and a second conductor couples the connecting element to the communication device.

15. The apparatus as set forth in claim 14, wherein the transmission line has a first impedance and the antenna has a second impedance, the first impedance being less than the second impedance.

16. The apparatus as set forth in claim 15, wherein the first impedance is approximately 50 ohms and the second impedance is greater than approximately 200 ohms and the second impedance is reactive.

17. The apparatus as set forth in claim 15, wherein the matching network matches the first impedance to the second impedance.

18. The apparatus as set forth in claim 1, wherein the antenna has an impedance greater than approximately 200 ohms.

19. The apparatus as set forth in claim 1, wherein the communication device is a transmitter.

20. The apparatus as set forth in claim 1, wherein the communication device is a receiver.

21. The apparatus as set forth in claim 1, wherein the communication device is a transceiver.

22. An apparatus positioned substantially beneath a surface, the apparatus comprising:

an annular slot antenna positioned substantially flush with the surface, the antenna capable of transmitting radiation when excited;

a can having a base and a sidewall;

a tuner element positioned within the can;

a communication device to excite the antenna; and a radial transmission line coupling the communication device to the antenna, the radial transmission line including the base of the can and the tuner element.

23. The apparatus as set forth in claim 22, further comprising a matching network coupling the communication device to the antenna, the matching network including the radial transmission line.

24. The apparatus as set forth in claim 23, wherein the matching network further includes a post coupling the antenna to the tuner element.

25. The apparatus as set forth in claim 22, wherein the communication device is a transceiver.

26. The apparatus as set forth in claim 22, further comprising:

the can further including a lip extending from the sidewall, the base of the can and the sidewall of the can defining a cavity, the lip of the can being included in the antenna;

a top plate having a conducting portion and a non-conducting portion, the conducting portion and the non-conducting portion being included in the antenna;

the tuner element positioned within the cavity of the can.

27. The apparatus as set forth in claim 26, wherein the lip of the can defines an annular shelf, and wherein a portion of the top plate is positioned on the annular shelf.

28. The apparatus as set forth in claim 23, further comprising:

a transmission line coupling the matching network to the communication device, the transmission line having a first impedance; and wherein the antenna has a second impedance, the first impedance being less than the second impedance.

29. The apparatus as set forth in claim 28, wherein the matching network matches the impedance of the transmission line to the impedance of the antenna.

30. The apparatus as set forth in claim 28, wherein the first impedance is approximately 50 ohms and the second impedance is greater than approximately 200 ohms and the second impedance is reactive.

31. The apparatus as set forth in claim 22, wherein the communication device is a transmitter.

32. The apparatus as set forth in claim 22, wherein the communication device is a receiver.

* * * * *